US005840377A

United States Patent [19]

Donnell

[11] Patent Number: 5,840,377

[45] Date of Patent: Nov. 24, 1998

[54] CONTAINER WITH JIGSAW PUZZLE COMPONENTS

[76] Inventor: John L. Donnell, 4881 Donald St., Eugene, Oreg. 97405

[21] Appl. No.: 811,222

[22] Filed: Mar. 5, 1997

Related U.S. Application Data

[63] Continuation-in-part of Ser. No. 49,953, Feb. 5, 1996.

[51] Int. Cl.[6] ..... A63F 9/12

[52] U.S. Cl. ..... 428/33; 220/4.28; 273/157 R

[58] Field of Search ..... 428/33; 273/157 R; 220/4.28

[56] References Cited

U.S. PATENT DOCUMENTS

| | | | |
|---|---|---|---|
| 3,485,496 | 12/1969 | Brunton | 273/157 R |
| 3,578,331 | 5/1971 | DeGast | 273/157 R |
| 4,140,317 | 2/1979 | Ramney | 428/33 X |
| 4,177,305 | 12/1979 | Feingold et al. | 273/157 R |
| 4,612,220 | 9/1986 | Baxter | 428/33 |
| 5,149,570 | 9/1992 | Cain | 428/33 |
| 5,165,689 | 11/1992 | Forsse et al. | 273/157 R |
| 5,330,806 | 7/1994 | Bythewood et al. | 428/33 |
| 5,351,957 | 10/1994 | Scott | 273/157 R |

*Primary Examiner*—Henry F. Epstein
*Attorney, Agent, or Firm*—James D. Givnan, Jr.

[57] ABSTRACT

A container is provided with a liner, such as a jigsaw puzzle, which is visible through translucent container walls. Retainers to hold the puzzle or puzzles in place against wall surfaces are panels in endwise engagement with one another. A modified form of retainer is a frame embodied in having a backing on which puzzle pieces are assembled and supported. Adhesive areas on the frame hold the frame and the assembled pieces in place against a container wall. Multiple positionable panels carried by a common base may also serve to retain the jigsaw puzzle pieces in place opposite a container wall. A method of providing a container with an assembled display is disclosed. The retainers may be of translucent material to render visible the inner surfaces of assembled puzzle pieces with a graphic display thereon.

16 Claims, 2 Drawing Sheets

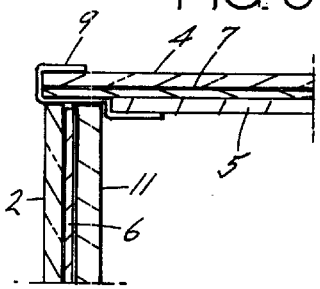
FIG. 5
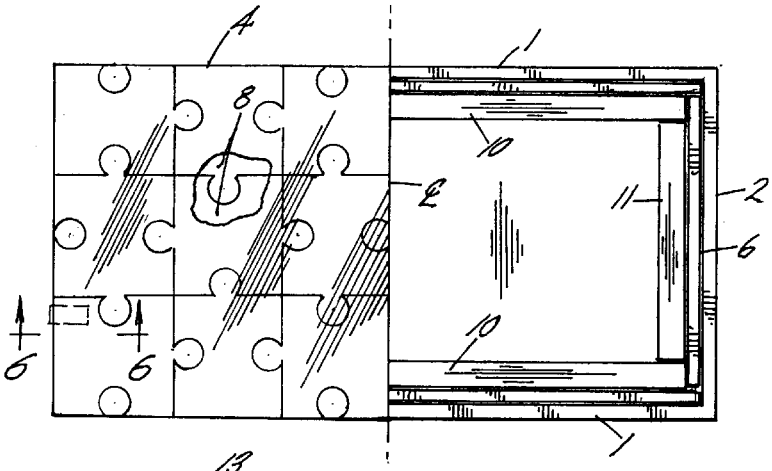
FIG. 6
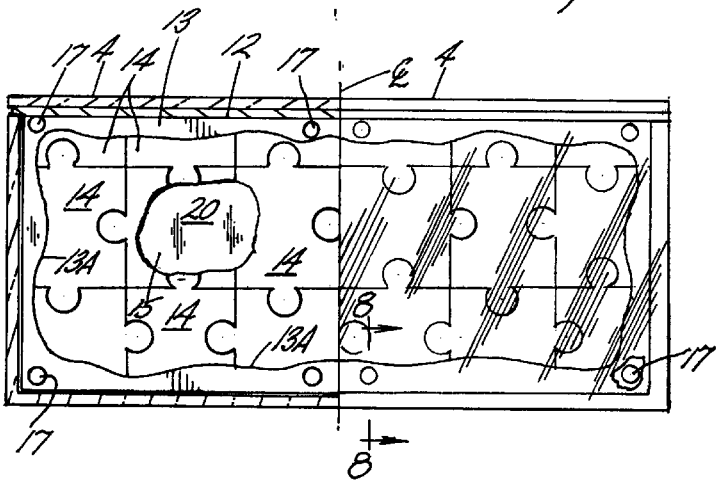
FIG. 7
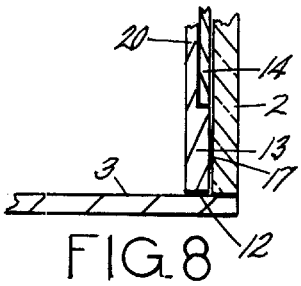
FIG. 8
FIG. 9
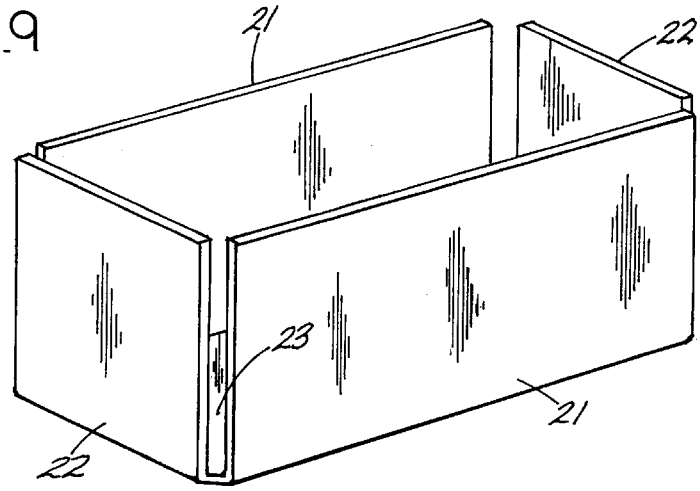
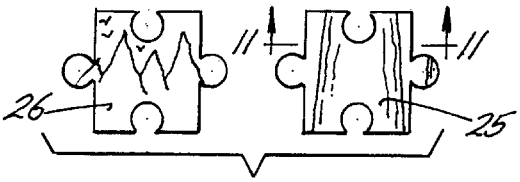
FIG. 10
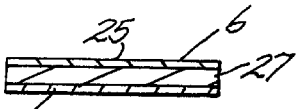
FIG. 11

CONTAINER WITH JIGSAW PUZZLE COMPONENTS

The present application is a continuation-in-part of copending design patent application, Ser. No. 29/049,953, filed Feb. 5, 1996, pending filed by the present inventor.

BACKGROUND OF THE INVENTION

The present invention pertains generally to receptacles, boxes, containers, etc., having wall members for the storage of various items and the display of decorative matter. Typically such containers may be provided with permanently applied graphics with no provision for the user to alter or change same or utilize jigsaw puzzles for display thereon.

Jigsaw puzzles, to the extent known, are typically assembled directly on a table surface or assembled within a cardboard frame with a backing of paper stock on which pieces are assembled. Such a cardboard frame with backing aids in keeping of the joined pieces assembled. Jigsaw puzzles, in general, are usually disassembled, after a period of time, for purposes of convenient storage.

SUMMARY OF THE PRESENT INVENTION

The present invention is embodied in a container having one or more translucent wall members on which a jigsaw puzzle, or puzzles, may be supported in assembled fashion.

The invention includes provision for retention of the assembled puzzle components in a manner permitting the contents to constitute an attractive liner for the container which can be removed from the container and disassembled to permit repeated assembly of the puzzle or other display. The container is of translucent material to allow a completed jigsaw puzzle or puzzles of a size to occupy a receptacle wall member or members. Retentive panels may abut the joined puzzle pieces to retain same in place yet permit their removal when desired. The jigsaw puzzles may include a carboard frame to simplify puzzle installation and removal. Retention on a wall member may alternatively be by adhesive means. Further, a modified retainer includes a walled structure with movable walls which may be utilized to support a jigsaw puzzle against container wall member.

Important features of the present invention include the provision of a receptacle or container with wall members against which a jigsaw puzzle or puzzles may be displayed; the provision of a receptacle achieving the foregoing objective with provision made for convenient removal of the puzzle enabling reassembly of the puzzle or installation of a new puzzle on the wall component; the provision of a receptacle having wall surfaces on which may be removably mounted various displays such as jigsaw puzzles to enable varying container appearance to suit the user's taste; the provision of a container for supporting assembled puzzle pieces with the assembled pieces having to meet the added criteria of matching the length and width of a container wall member.

BRIEF DESCRIPTION OF THE DRAWINGS

In the accompanying drawings:

FIG. 5 is a plan view thereof with a translucent closure broken away along a center line to disclose internal components;

FIG. 6 is a vertical sectional view taken along line 6—6 of FIG. 5;

FIG. 7 is a side elevational view of a modified form of the present invention with a translucent wall component broken away along a center line to disclose internal components;

FIG. 8 is a vertical sectional view taken along line 8—8 of FIG. 7;

FIG. 9 is a perspective view of a walled liner as a further modification;

FIG. 10 is a plan view of a puzzle piece with a display on each side; and

FIG. 11 is a sectional view taken along line 11—11 of FIG. 10.

DETAILED DESCRIPTION OF THE PREFERRED EMBODIMENTS

Figure 1:
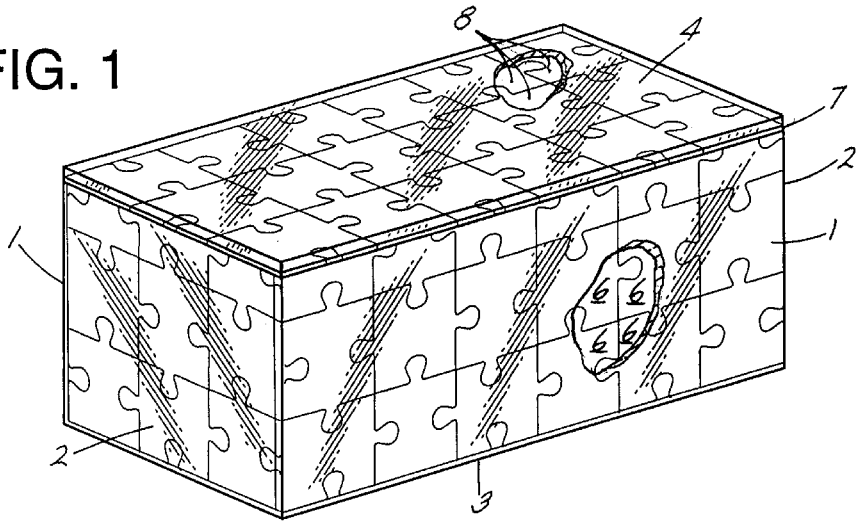
FIG. 1 is a perspective view of the present invention.
Figure 2:
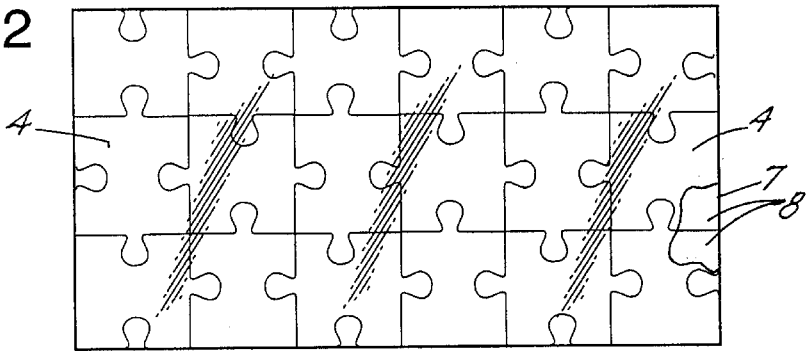
FIG. 2 is a top plan view thereof.
Figure 3:
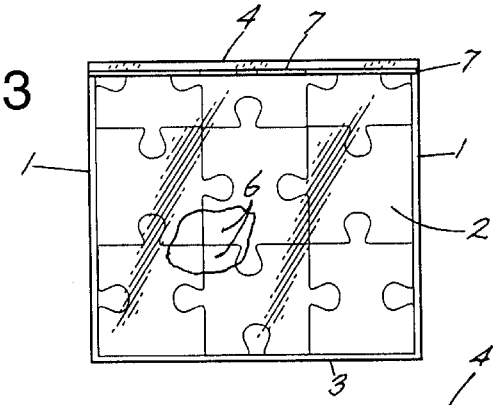
FIG. 3 is an end view thereof taken from the left side of FIG. 2, the end opposite being a mirror image.
Figure 4:
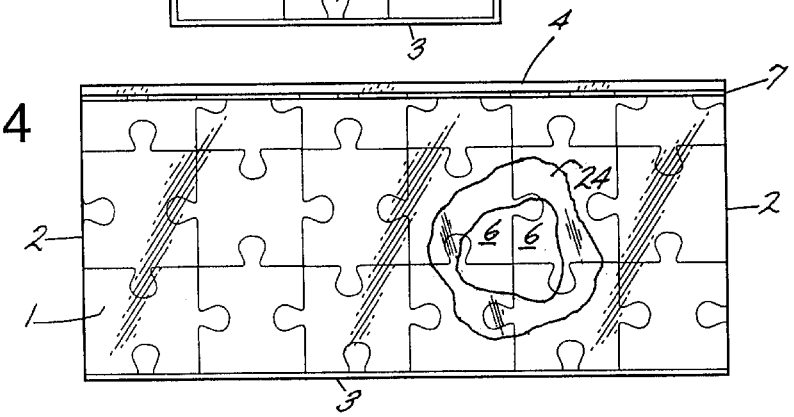
FIG. 4 is a side elevational view thereof, the side opposite being a mirror image.

With continuing attention to the drawings wherein reference numerals indicate parts similarly hereinafter identified, the reference numeral 1 indicates side walls of the present container while the reference numeral 2 identified container end walls, of a translucent, rigid material. The wall components 1 and 2 are suitably joined along their corresponding edges to form, along with a bottom wall 3, a container for the storage of various items. A closure 4 shown in the form of a lid is preferably also of translucent material for display purposes, as later explained, and in rested engagement with the wall members 1 and 2.

A liner for the container includes a display of assembled jigsaw puzzle pieces 6 of size and shape to abut and occupy the inner surfaces of wall members 1 and 2. A liner component 7 for lid 4 may be of like construction with puzzle pieces at 8 attached, as shown in FIG. 5, by a retentive plate member 5 suitable secured to lid 4, as for example, by tape segments 9, shown in FIG. 6, or clips of generally U-shape.

With further attention to FIG. 5, it will be seen that assembled liner components 6 are held in abutment with their respective wall members 1 and 2 by retentive side and end panels at 10 and 11 sized to effect snug engagement at their adjacent ends. A suitable rigid material from which the panels may be formed is that termed foam core board which is of light weight, rigid nature. The liner components 10–11 are held in place as by frictional engagement of their ends and hence may be manually removed when liner components are to be altered.

In FIG. 7, a modified form of the invention is disclosed wherein a liner component 12 includes a frame 13 which corresponds in length and width to its abutted wall member. Puzzles with frames are known in the jigsaw puzzle trade with the frame integral with a backing member 20 which jointly define a recessed area 15 in which puzzle pieces 14 are assembled to occupy area 15. Puzzle pieces 14 and frame 13 provide a coplanar surface for abutting engagement with the inner surface of a wall component to be held in abutment therewith by adhesive surfaces 17 spaced about the frame. A continuous inner edge 13A of the frame may be irregular or linear. The foregoing modified form of retentive means dispenses with the need for earlier described panels. Closure 4 may be similarly provided with a frame equipped puzzle in which jigsaw puzzle pieces are supported by a backing 20 of a frame member with the frame being removably joined to the lid by adhesive means of the type indicated above at 17 in conjunction with the above description of frame 13.

In FIG. 9 still further retentive means is disclosed and is embodied within multiple retainers 21–22 each integral with a base 23 with the retainers and base being formed from sheet material permitting flexing along each of their junctures with base 23. The wall shaped retainers 21–22 are disposed in an upright manner to retain liner components associated therewith in abutment with the sides 1 and ends 2 of a container while permitting removal of each liner component by momentary inward displacement of a retainer for access to the liner component.

To facilitate handling of assembled jigsaw puzzle pieces 6 the same may be prevented from separation from one another by the application of an adhesive strip 24 to the assembled pieces. The strip would be of a transparent nature, of course, if applied to the display bearing side of the pieces.

In assembling the present container, the joined pieces providing a display seen through the container walls, are preferably joined exteriorly of the container and subsequently installed in place against the interior surface of a container wall. To facilitate such positioning, the assembled pieces may be interconnected by adhesive strip 24. In those instances where the pieces are initially joined within a frame, as indicated at 13, the frame is positioned with the assembled pieces thereon, in place against an inner container wall surface. When the frame is provided with adhesive areas as at 17, the same are suitable to retain the frame in place on a wall or closure and constitute retentive means. The box-like structure shown in FIG. 9 with movable walls 21 and 22 may be utilized as retentive means upon placement within the interior of a container. Installation and removal of the assembled pieces providing a display is permitted by momentary inward displacement of wall 21 or 22 whereafter the assembled pieces are retained thereby in wall engagement.

A still further modification resides in the provision of a retentive means of translucent material, as for example, from the acrylic resinous material sold under the registered trademark LUCITE. The side and end panels 10 and 11, backing member 20 as well as the multiple retainers 21–22 in FIG. 9 could all be of a translucent material to permit viewing of the back or inwardly facing surfaces of assembled puzzle pieces, the sides of which pictorial displays are provided. Accordingly a jigsaw puzzle formed from the assembled pieces 6 or 7 or 8 or 14 could be removed from the present container, turned end-for-end and reinstalled in the container to vary internal and external appearance of the container.

The puzzle pieces, usable with the immediately foregoing modified forms of the invention, would bear a pictorial or graphic display on each overlay at 25 and 26 on a planar base member 27 of a puzzle piece as shown in FIGS. 10 and 11.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A walled receptacle including, a translucent wall member of rigid construction, a liner component including Jigsaw puzzle pieces providing a display when assembled, and retentive means for maintaining said liner component when assembled in place in surfacial abutment with said wall member.

2. The receptacle claimed in claim 1 additionally including multiple translucent wall members integral with said wall member.

3. The receptacle claimed in claim 2 additionally including a translucent closure in place on said wall members.

4. The receptacle claimed in claim 3 additionally including a closure liner including assembled jigsaw puzzle pieces, closure liner rententive means maintaining said closure liner in place in abutment with said closure.

5. The receptacle claimed in claim 2 wherein said retentive means includes a panel in abutment with said liner component.

6. The receptacle claimed in claim 5 wherein said retentive means includes multiple panels in endwise angular engagement with one another, each of said panels additionally in surfacial abutment with said liner component.

7. The receptacle claimed in claim 1 wherein said retentive means is a frame having a backing on which said puzzle pieces rest when assembled.

8. The receptacle claimed in claim 7 wherein said frame includes an adhesive applied to said frame for adherence of the frame to said wall member.

9. The walled receptacle claimed in claim 1 wherein said retentive means includes translucent components through which said liner component is visible, said jigsaw puzzle pieces each having multiple pictorial displays oppositely disposed thereon.

10. A walled container comprising, wall components of a translucent nature, a liner comprising segments in surfacial abutment with one or more of said wall components and each of said segments having an image thereon, said segments viewable through said one or more wall components, and retentive means in contact with said liner to retain the liner in abutment with one or more of said wall components.

11. The walled container claimed in claim 9 additionally including a closure supported by said wall components, a closure liner in abutment with said closure and closure liner retentive means in contact with said liner.

12. The walled container claimed in claim 10 wherein said retentive means is a frame having a backing.

13. The walled container claimed in claim 12 wherein said frame includes an adhesive thereon for adherence to one of said wall components.

14. The walled container claimed in claim 10 wherein said retentive means includes multiple panels, each of said panels in abutment with said liner.

15. The walled container claimed in claim 10 additionally including an adhesive strip in contact with said liner.

16. The walled container claimed in claim 10 wherein said retentive means includes translucent components through which said liner is visible, said segments of the liner each having opposite sides with an image on each of said sides.

* * * * *